United States Patent [19]

Nishimura et al.

[11] Patent Number: 4,622,923

[45] Date of Patent: Nov. 18, 1986

[54] ENCASED ENGINE GENERATOR

[75] Inventors: Akira Nishimura; Masami Yoshii; Shigeharu Yasui, all of Chaya, Japan

[73] Assignee: Yanmar Diesel Engine Co., Ltd., Chaya, Japan

[21] Appl. No.: 705,293

[22] Filed: Feb. 25, 1985

[30] Foreign Application Priority Data

Jul. 31, 1984 [JP] Japan ..... 59-162347

[51] Int. Cl.[4] ..... F02B 67/04

[52] U.S. Cl. ..... 123/2; 123/41.65; 123/198 E; 181/283; 220/85 VS; 290/1 B

[58] Field of Search ..... 123/2, 195 C, 198 E, 123/41.65; 290/1 B, 1 R; 181/212, 283; 220/85 S, 85 VS, 85 VR

[56] References Cited

U.S. PATENT DOCUMENTS

| | | | |
|---|---|---|---|
| 2,355,208 | 8/1944 | Devol et al. | 290/1 B |
| 3,259,752 | 7/1966 | Honda | 123/41.62 |
| 3,666,139 | 5/1972 | Urban | 220/85 S |
| 3,949,727 | 4/1976 | Thien et al. | 123/198 E |
| 4,173,951 | 11/1979 | Ishihara | 123/2 |
| 4,226,214 | 10/1980 | Palazzetti | 123/2 |

FOREIGN PATENT DOCUMENTS

| | | | |
|---|---|---|---|
| 197417 | 11/1983 | Japan | 123/2 |

*Primary Examiner*—William A. Cuchlinski, Jr.
*Attorney, Agent, or Firm*—Leonard Bloom

[57] ABSTRACT

This invention relates to an encased engine generator having an air-cooled engine and a generator housed in a case approximately structured in a rectangular parallelepiped, wherein a fuel tank is provided along the upper surface of the case, an engine having a cooling fan at its side is disposed within the case beneath said fuel tank, a generator interlocked with said engine is disposed at the downstream side of the cooling air from said cooling fan, a silencer is disposed between said fuel tank and generator so that its outer circumference may be cooled by part of said cooling air, and operating parts such as engine operation knob necessary for operation and maintenance are provided on the wall of the case which encloses the remaining cooling air.

14 Claims, 19 Drawing Figures

ENCASED ENGINE GENERATOR

BACKGROUND OF THE INVENTION

This invention relates to an improvement of an encased engine generator having an air-cooled engine and generator accommodated in a case.

In a conventional encased engine generator, a silencer which becomes hot is disposed together in the case. However, when the silencer is contained in the case, in order to prevent the heat generated in its surroundings from propagating throughout the case, it was necessary to enclose the silencer with heat insulating material, divide the case with a partition wall, or otherwise provide a containing part separately within the case.

As a result, it was difficult to dispose the accessory parts at the front side of the head space in the case, and the case size and weight increased.

This invention is intended to present an encased engine generator by reducing the case size and disposing all operating parts necessary for operation and maintenance at the front side of the case so that all handlings for operation and maintenance may be effected easily.

In order to achieve this purpose, this invention, in an encased engine generator having an air-cooled engine and generator housed within a case of which outer structure is approximately a rectangular parallelepiped, possesses a fuel tank provided along the upper surface of the case, an engine having a cooling fan at its side disposed within the case beneath said fuel tank, and a generator interlocked with said engine located at the downstream side of the cooling air from said cooling fan, wherein a silencer is provided between the fuel tank and generator so that its outer surface may be cooled by part of said cooling air, and operating parts such as engine operation knob necessary for operation and maintenance are provided on the front side wall of the case enclosing the remaining cooling air.

BRIEF DESCRIPTION OF THE DRAWINGS

FIG. 2 (*a*) is a vertical sectional view of a mounting leg;

FIG. 2 (*b*) is an arrow II b view of FIG. 2 (*a*);

FIG. 2 (*c*) is an arrow II c view of FIG. 2 (*a*);

FIG. 3 (*a*) is a partially cut-away front view of the generator;

FIG. 3 (*b*) is an arrow III view of FIG. 3 (*a*);

FIG. 3 (*c*) is a perspective exploded view of cooling fan and recoil starter;

FIG. 3 (*d*) is a perspective exploded view of an air bleeder;

FIG. 3 (*e*) is an enlarged portion of FIG. 3

FIG. 4 (*a*) is a perspective exploded view of a silencer;

FIG. 4 (*b*) is a perspective exploded view of a front panel;

FIG. 4 (*c*) is a perspective exploded view of a carburetor;

DETAILED DESCRIPTION OF THE INVENTION

Figure 1:
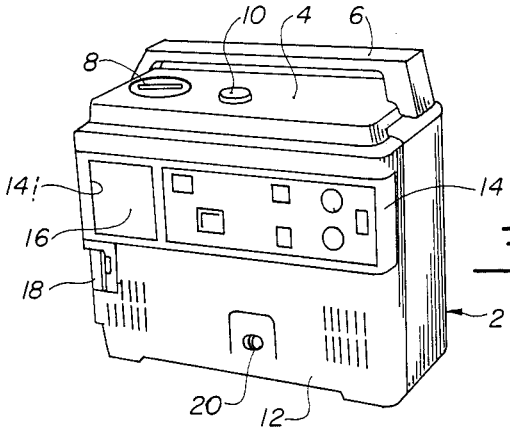
FIG. 1 is a perspective outline view of an encased engine generator according to this invention.

In FIG. 1 showing an encased engine generator according to the present invention, numeral 2 is a case having an approximately rectangular parallelepiped appearance, in which engine and generator are accommodated as described below. The upper part of a fuel tank 4 is exposed on the upper surface of the case 2, and a handle 6 is provided above the fuel tank 4. An oil feed port 8 and a oil level gauge 10 are provided at the front side of the upper surface of the fuel tank 4.

A front panel 14, air cleaner cover 16, starter handle 18, and lubricating oil feed port 20 (all operating parts) necessary for operation and maintenance are concentrated on a front plate 12 of the case 2.

Figure 2:
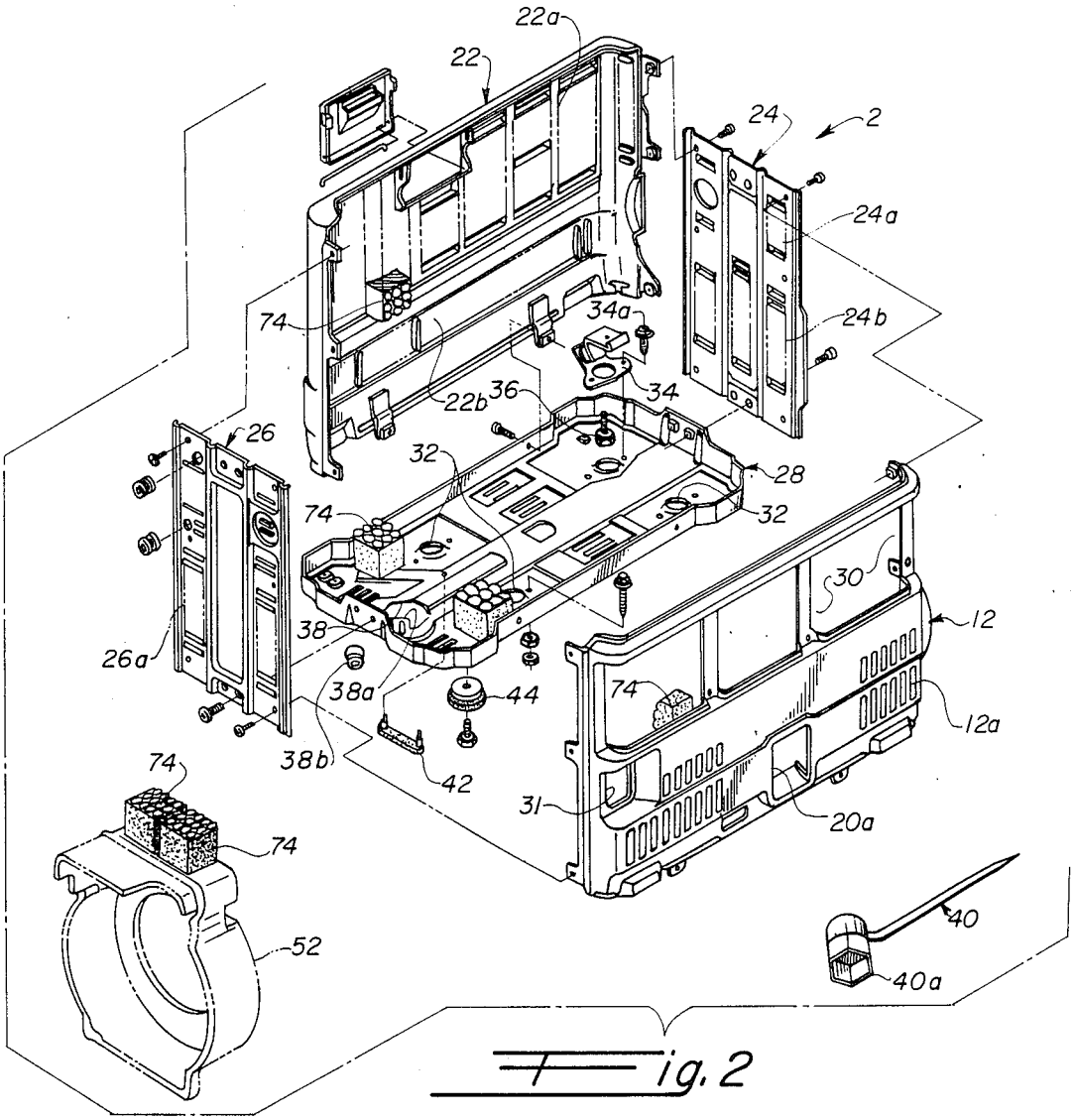
FIG. 2 a perspective exploded view of the case.
Figure 2A:
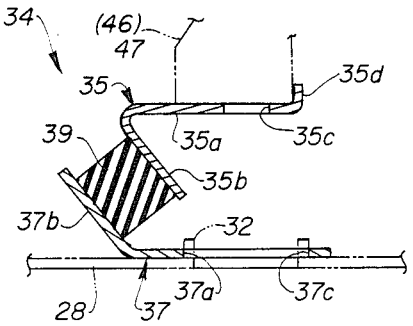
Figure 2B:
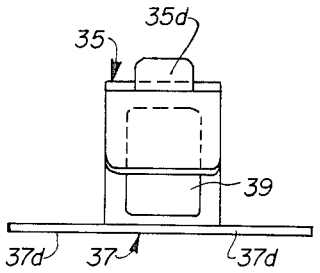
Figure 2C:
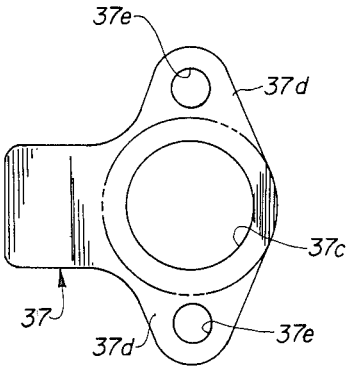

The case 2 is, as shown in FIG. 2, assembled in an approximately rectangular parallelepiped with the upper side open, comprising the front plate 12, rear plate 22, right side plate 24, left side plate 26, and bottom plate 28 which are fastened together with screws, and the upper opening is covered with the fuel tank 4. An opening 30 for mounting the front panel 14 is formed in the upper part of the front plate 12, while an opening 31 for the starter handle 18, opening 20*a* lubricating oil feed port 20, and louver 12*a* are formed in its lower part. Also louvers 22*a*, 24*a*, 26*a* are formed in the rear plate 22, right side plate 24, and left side plate 26, respectively. Ring projections 32 for mounting the engine and generator are provided in the bottom plate 28, and it is designed to position mounting legs 34 on the ring projections 32 and fix with bolts 34*a*. Mounting bolts 36 are to be tightened from the bottom side of the bottom plate 28. A tool mounting hole 38 is provided in the bottom plate 28, the head 40*a* of a tool 40 is fitted into a cap 38*b* which is joined to the projection 38 of the tool mounting hole 38, and the tool 40 is detachably mounted by means of mounting rubber 42. Legs 44 are fixed to the bottom of the bottom plate 28.

Referring now to FIG. 2 (*a*) and FIG. 2 (*c*), the mounting leg 34 (engine mounting device) is explained below. The mounting leg 34 is composed of upper plate 35, lower plate 37, and vibrationproof rubber 39. The upper plate 35 is a steel plate being bent by press, in which horizontal piece 35*a* and inclined piece 35*b* are formed. A mounting hole 35*c* for an engine 46 is formed in the horizontal piece 35*a*, while a vertically bent projection 35*d* (see FIG. 2 (*b*)) is provided at the right end of the horizontal piece 35*a* in FIG. 2 (*a*). The projection 35*d* fits with the inner edge of a flange 47 formed in the bottom of the engine 46 (see FIG. 5). The bottom plate 37 is similarly composed of horizontal piece 37*a* and inclined piece 37*b*, and a positioning hole 37*c* is formed on the same center line as that of mounting hole 35*c* in the horizontal piece 37*a*, so that the engine may be mounted easily from beneath the bottom plate. The diameter of the positioning hole 37*c* is larger than that of the mounting hole 35*c*, and matches with the ring projection 32 on the bottom plate 28 so that the mounting leg 34 may be determined at a specified position on the bottom plate 38. In the horizontal piece 37*a*, as shown in FIG. 2 (*c*), a flange 37*d* is formed, and a bolt 34*a* (FIG. 2) is inserted into the mounting hole 37*e* of the flange 37*d* so as to fix the mounting leg 34 to the bottom plate 28. The two inclined pieces 35*b*, 37*b* are inclined parallel to each other, and vibrationproof rubbers 39 are baked and affixed to the both inclined pieces 35*a*, 37*b*.

Figure 5:
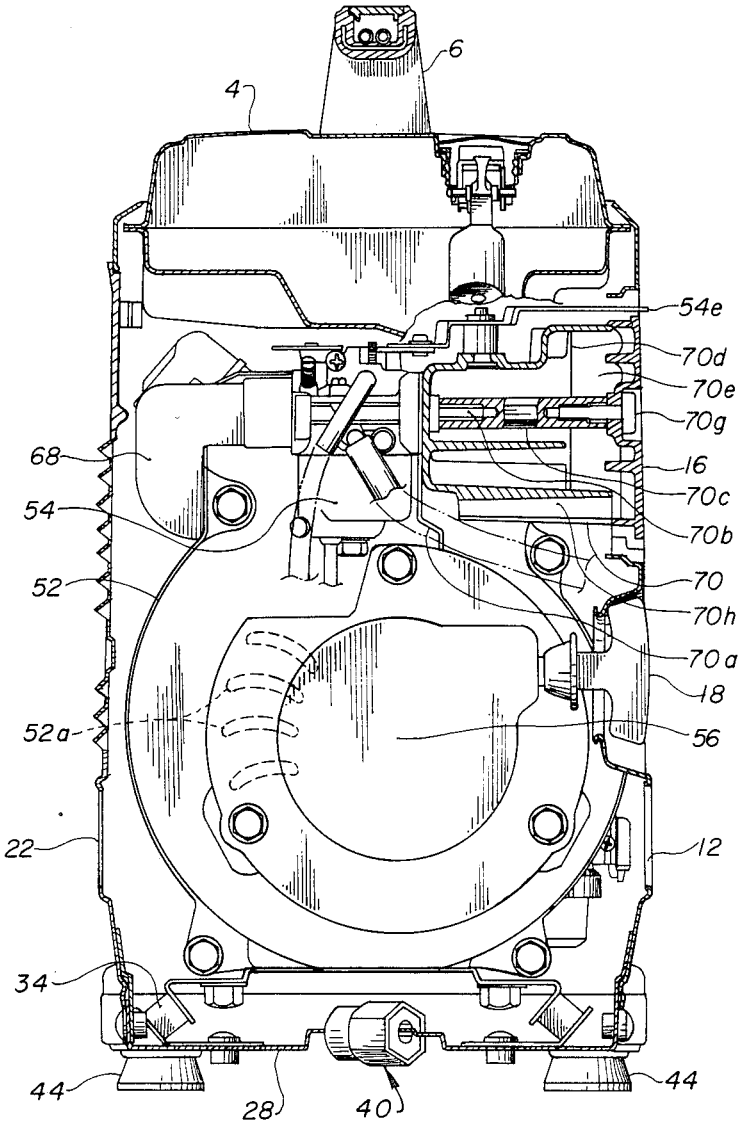
FIG. 5 is a V—V sectional view of FIG. 3.

The mounting leg 34 shown in FIG. 5 is disposed at four positions (FIG. 2) of the bottom plate 28 so that the center of gravity of engine and generator may be positioned beneath the intersecting point on the extension of the center line of the fibration rubbers 39.

Figure 3A:
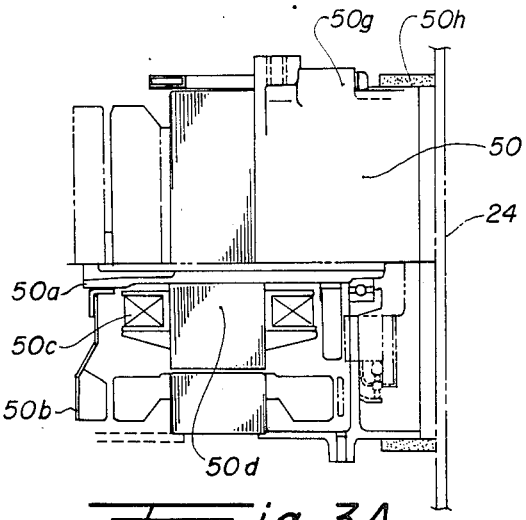
FIG. 3 is a front view of the encased engine generator minus its front plate.
Figure 3B:
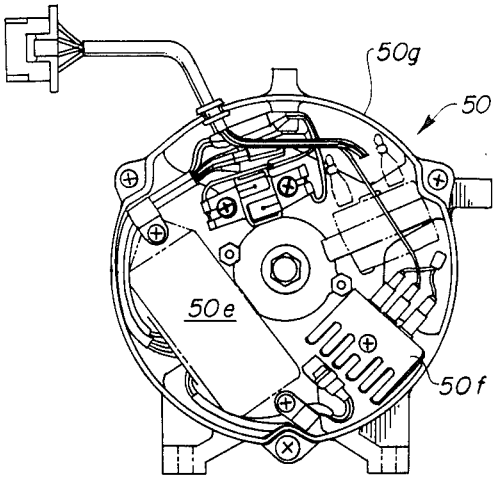
Figure 3:
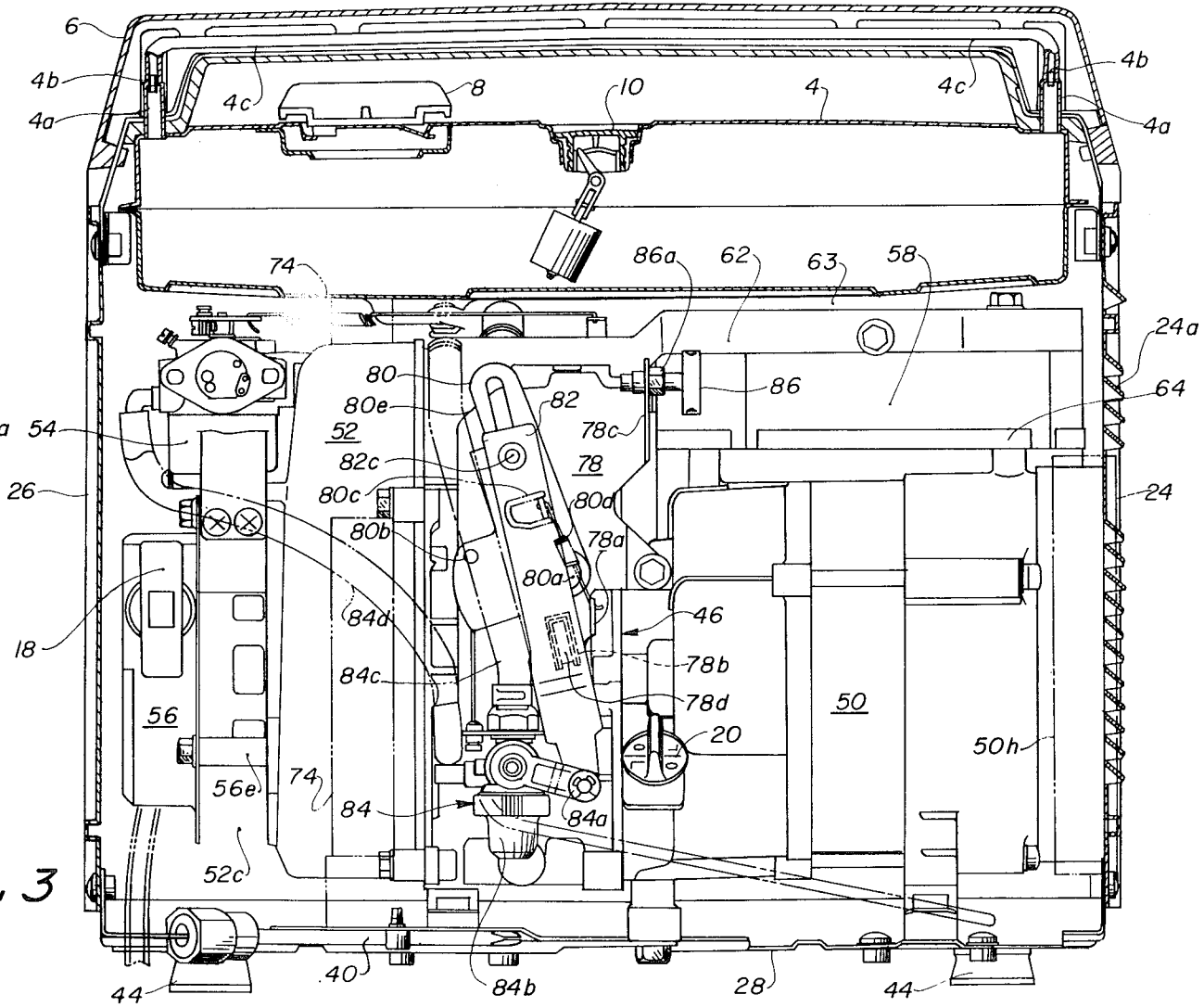
Figure 3E:
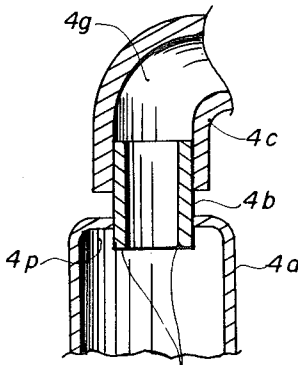
Figure 3C:
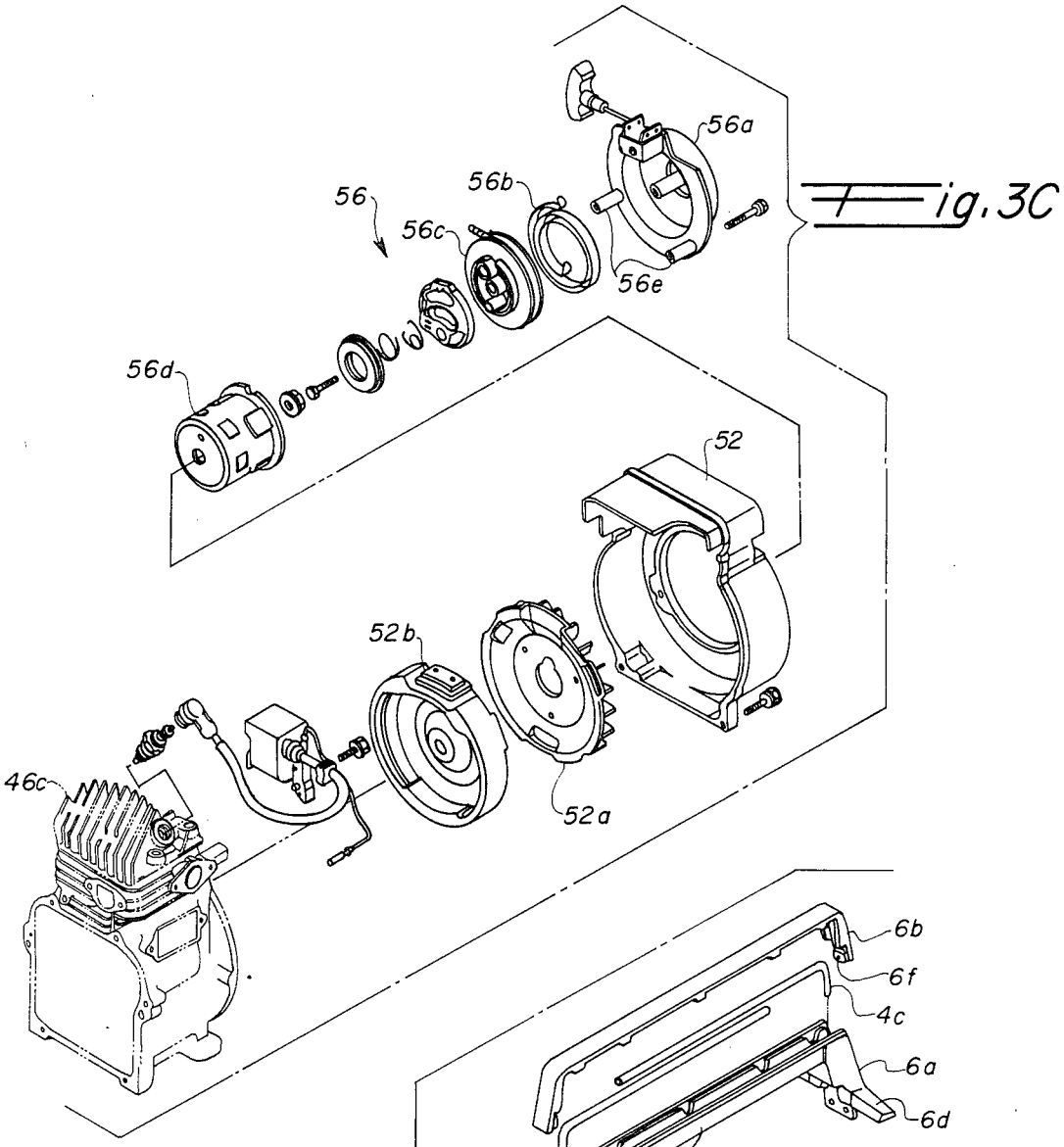
Figure 3D:
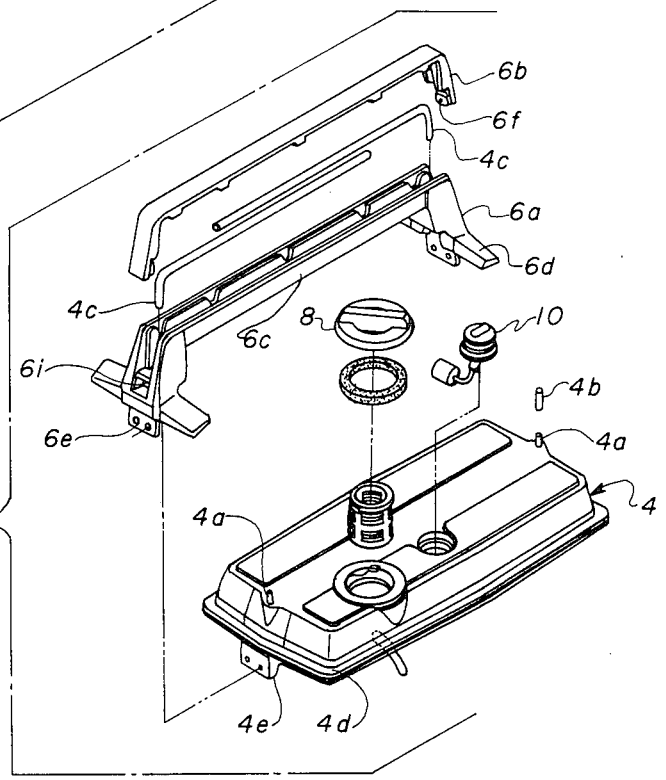

In FIG. 3 which is a front view of the assembled encased engine generator minus its front plate 12, the engine 46 is located in the middle beneath the fuel tank 4. This engine 46 may be, for example, a side-valve type single-cylinder gasoline engine, and the cylinder part of the engine 46 is covered with a plate bracket (which is described in details below) serving as the engine cover. On one side of the engine 46, that is, at the right side in FIG. 3, a generator 50 is provided and it is connected to the output shaft of the engine 46.

As shown in FIG. 3 (*a*), FIG. 3 (*b*), a centrifugal fan 50*b* is provided at the engine 46 side of the rotating shaft 50*a* of the generator 50, and it serves to cool the coil 50*c* and iron core 50*d*. At the right side plate 24 side of the generator 50, voltage regulator 50*e*, rectifier 50*f*, etc. are contained, and a packing 50*h* is affixed to the outer surface of the cover 50*g*, and this packing 50*h* tightly contacts with the right side plate 24 and guides the air sucked in by the centrifugal fan 50*b* from the louver 24*a* (FIG. 2, FIG. 3) into the cover 50*g*.

On the other side of the engine 46, that is, at the left side in FIG. 3, a fan cover 52 is provided, and a centrifugal fan (a cooling fan) is housed in this fan cover 52. Further left to the fan cover 52 are disposed carburetor 54 and recoil starter 56 having a leg part 56*e* for forming a clearance 52*c* for taking in the cooling air.

The air bleeder is described below while referring to FIG. 3 (*d*). A mouth ring 4*a* of a relatively large diameter, projecting by a specified dimension, is provided at right and left ends of the upper surface of the fuel tank 4, and a small connection pipe 4*b*, for example, 2 mm in inside diameter (see FIG. 3) is fitted into the mouth ring 4*a* with the lower end 4*f* thereof projecting from the upper end opening of the mouth ring 4*a* into its inside. A vinyl tube 4*c* (a flexible tube) forming the upper end side passage 4*g* is fitted to the upper end of each connection pipe 4*b*. The two vinyl tubes 4*c* are disposed side by side within the handle 6, and their ends are open to the atmosphere.

The handle 6 consists of body 6*a* and upper cover 6*b*, and the mounting part 6*d* of the body 6*a* is fitted to the side edge 4*d* of the fuel tank 4, and the bracket 6*e* of the handle 6 is bolted to the bracket 4*e* of the fuel tank 4, thereby fitting the handle 6 to the fuel tank 4. The vinyl tubes 4*c* are placed parallel inside the holding part 6*c* of the body 6*a*. The upper cover 6*b* is fitted to the body 6*a* so that the air may pass freely within the holding part 6*c*, with the convex part 6*f* matched with the concave part 6*i*.

As shown in FIG. 3 (*c*), a centrifugal fan 52*a* and flywheel 52*b* are accommodated in a fan cover 52, and a recoil starter 56 is attached to the side of the fan cover 52. The recoil starter 56 is composed of main body 56*a*, spiral spring 56*b*, reel 56*c*, drum 56*d*, etc., and a leg part 56*e* is formed in the body 56*a* so as to form a clearance 52*c* (FIG. 3) between the recoil starter 56 and fan cover 52.

Meanwhile, air breathers 4*a* are provided in the fuel tank 4 in FIG. 3, and vinyl tubes 4*c* are fitted to them by way of small connection pipes 4*b*, for example, 2 mm in inside diameter. The vinyl tubes are disposed by side within the handle 6, and their ends are open to the atmosphere.

Figure 4:
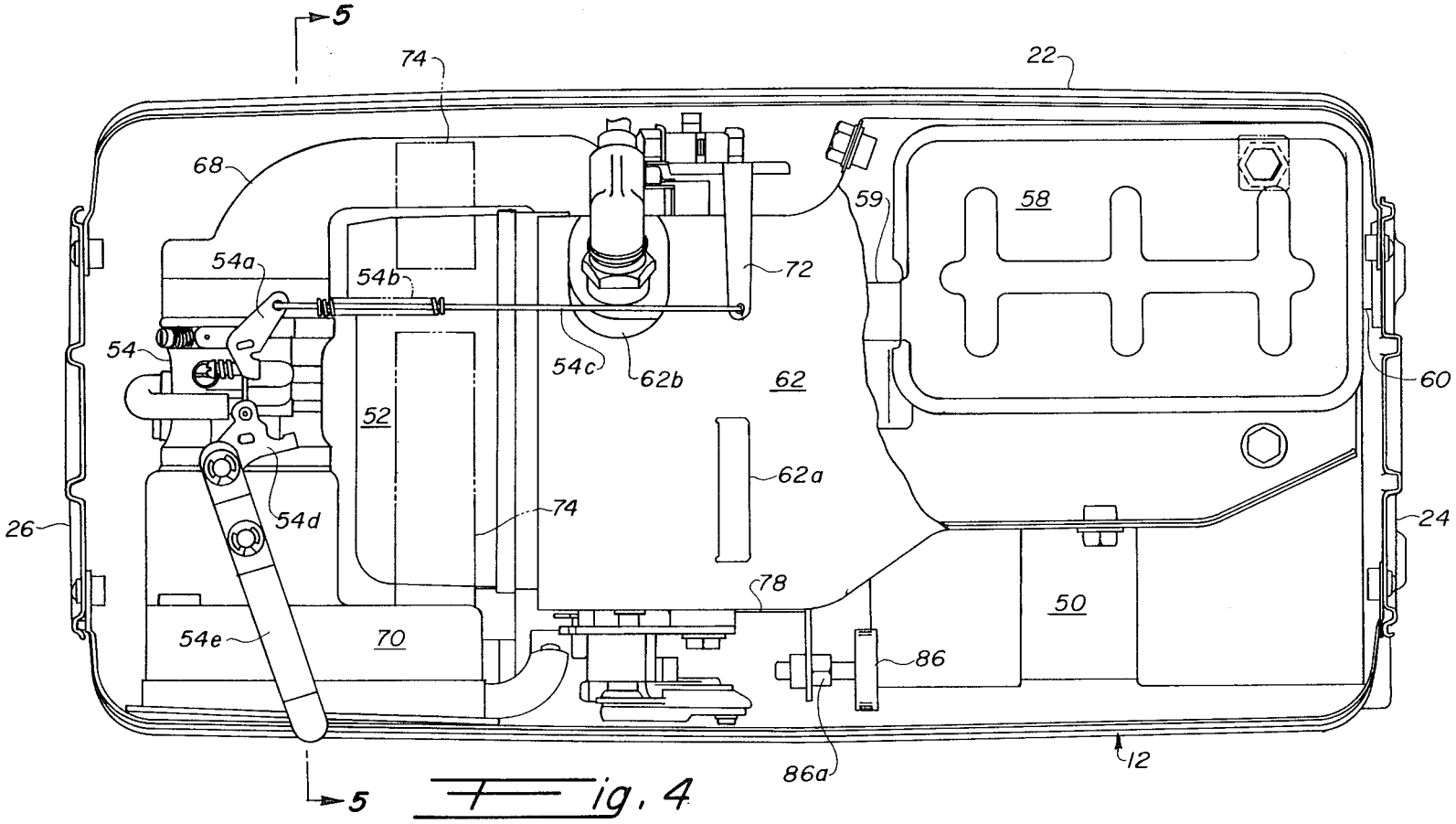
FIG. 4 a plan view (a top view) of the encased engine generator minus its fuel tank.
Figure 4A:
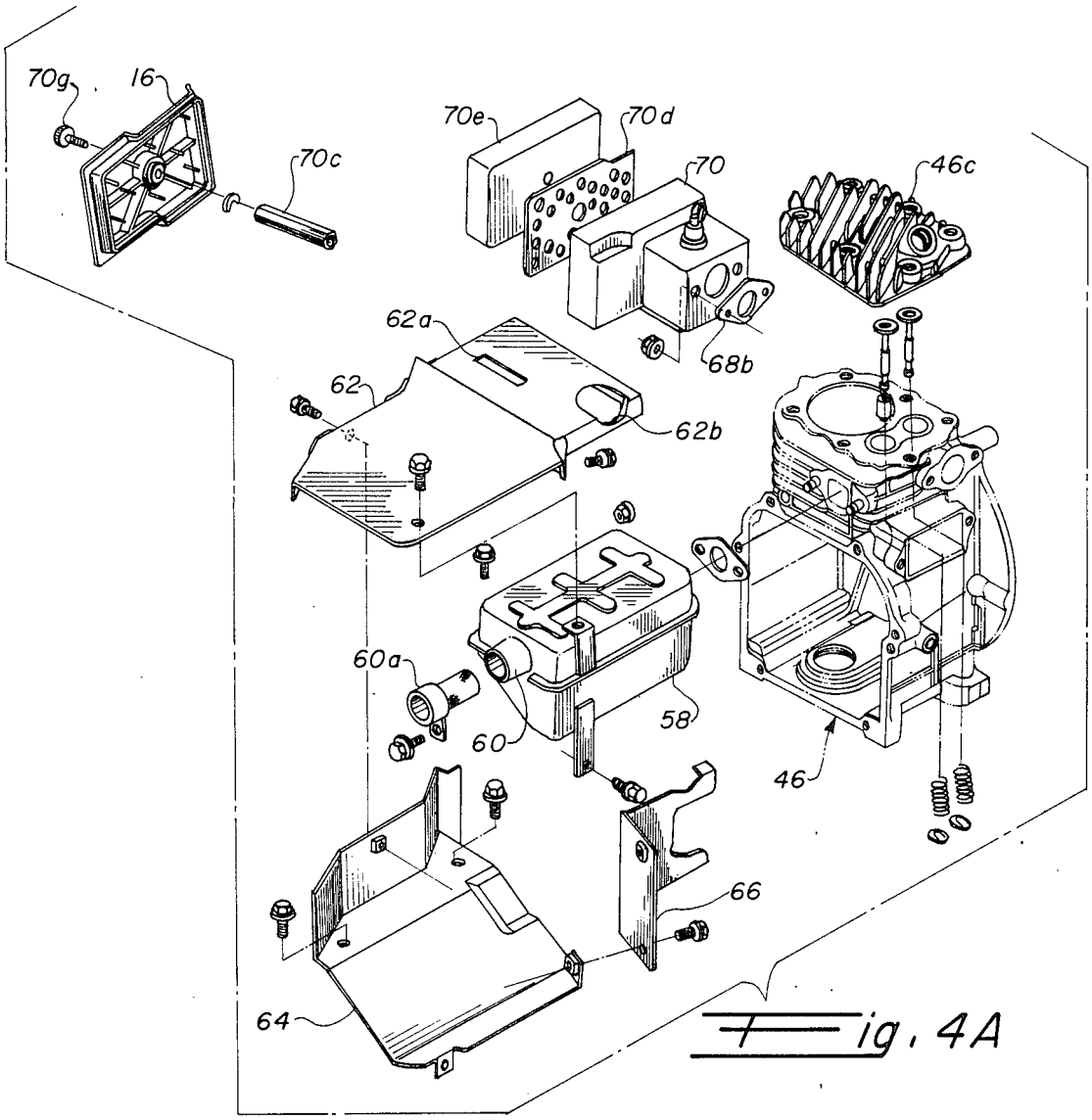
Figure 4B:
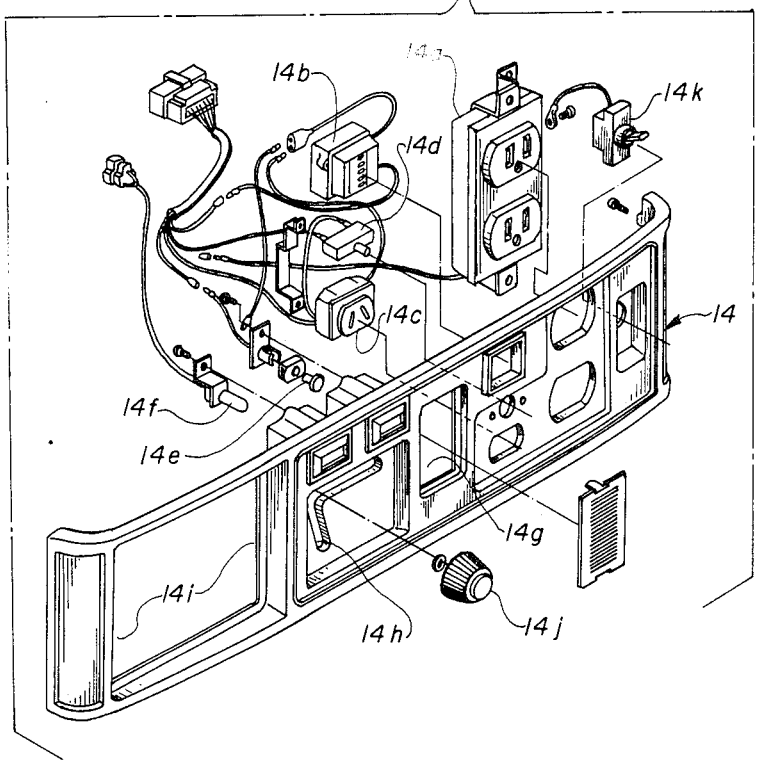
Figure 4C:
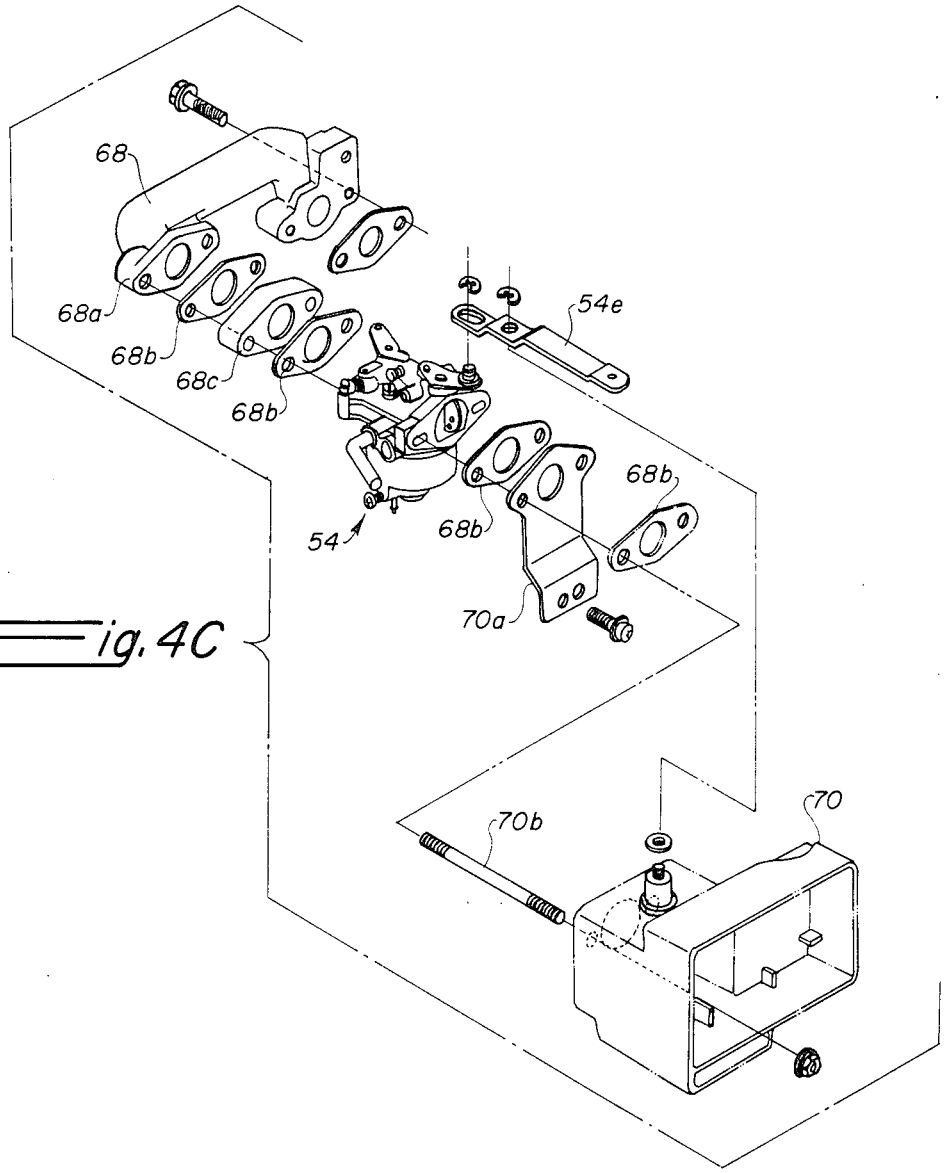

In FIG. 4 which is a top view of the assembled encased engine generator minus its fuel tank 4 and handle 6, a silencer 58 is disposed in the free space at the rear plate 22 side between the generator 50 and fuel tank 4.

An exhaust pipe 59 is connected to the silencer 58, and the exhaust port 60 of the silencer 58 is provided at the right side. The silencer 58 is covered with upper cover 62, lower cover 64, and side cover 66 as shown in FIG. 4 (*a*). The upper cover 62 also covers the cylinder head 46*c* of the engine 46, and an opening 62*a* and plug hole 62*b* are formed in it. A metal net spark arrester tube 60*a* is fitted to the exhaust port 60 of the silencer 58 in order to prevent release of sparks.

The upper cover 62 has a clearance 63 against the fuel tank 4 as shown in FIG. 3, and part of the cooling air by the centrifugal fan 52*a* flowing out from the opening 62*a* is passed into this clearance 63, thereby preventing the fuel tank 4 from being heated by the heat of silencer 58. The cooling air in the clearance 63 is discharged from above the upper louvers 24*a* and 22*a* of the right side plate 24, and the majority of the cooling air of the centrifugal fan 52*a* and the cooling air by the centrifugal fan 50*b* of the generator 50 are discharged outside from a slit window 22*b* of the rear plate 22.

The space enclosed by generator 50, silencer 58 and fuel tank 4 is filled with an alternating-current line plug socket 14*a*, frequency counter 14*b*, direct-current line plug socket 14*c*, circuit breaker for direct current 14*d*, circuit breaker for alternating current 14*k*, pilot lamp 14*e*, oil warning lamp 14*f* and other attached to the front panel 14 as shown in FIG. 4 (*b*). The front panel 14 also comprises frequency changeover window 14*g*, inverted L-shaped groove 14*g*, and opening 14*i*. A knob 14*j* for engine operation is fitted to the inverted L-shaped groove 14*h*.

As shown in FIG. 4, the carburetor 54 is connected to an air intake pipe 68 being roughly in a pi-shape, and an air cleaner 70 is attached to the carburetor 54. A rod 54*a* having a tension spring 54*b* is linked to a throttle valve lever 54*a* of the carburetor 54, and the rod 54*c* is connected to a governor lever 72. A choke lever 54*e* is connected to a choke valve lever 54*d* of the carburetor 54, and the end of the choke lever 54*e* is exposed from the front plate 12.

These air intake device parts are fastened to the flange part 68*a* of the intake pipe 68, as shown in FIG. 4 (*c*), by way of packing 68*b* and insulator 68*c*, being tightened with through-bolts 70*b* between the carburetor 54 and air cleaner 70 by way of carburetor support plate 70*a* and packing 68*b*. Center bolts 70*c* are screwed into the through-bolts 70*b* projecting into the air cleaner 70 as shown in FIG. 5, and bolts 70*g* for fixing a porous plate 70*d*, air cleaner element 70*e* and air cleaner cover 16 are screwed into the ends of the center bolts 70*c* (see FIG. 4 (*a*). The air cleaner cover 16 is located at the opening 14*i* of the front panel 14, and the air intake hole 70*h* of the air cleaner 70 is opened inward.

As shown in FIG. 3 and FIG. 4, urethane seal 74 (partitioning member) is provided around the fan cover 52. The urethane seal 74 is to divide the space in the case 2, and is adhered to the front plate 12, rear plate 22, bottom plate 28 and fan cover 52 as shown in FIG. 2.

Therefore, the air at the side of engine 46 and silencer 58 where the temperature is high hardly flows into the space at the intake device side partitioned by the urethane seal 74. A clearance is given in the passage of the tension spring 54*b* against the urethane seal 74 (FIG. 4).

Figure 6:
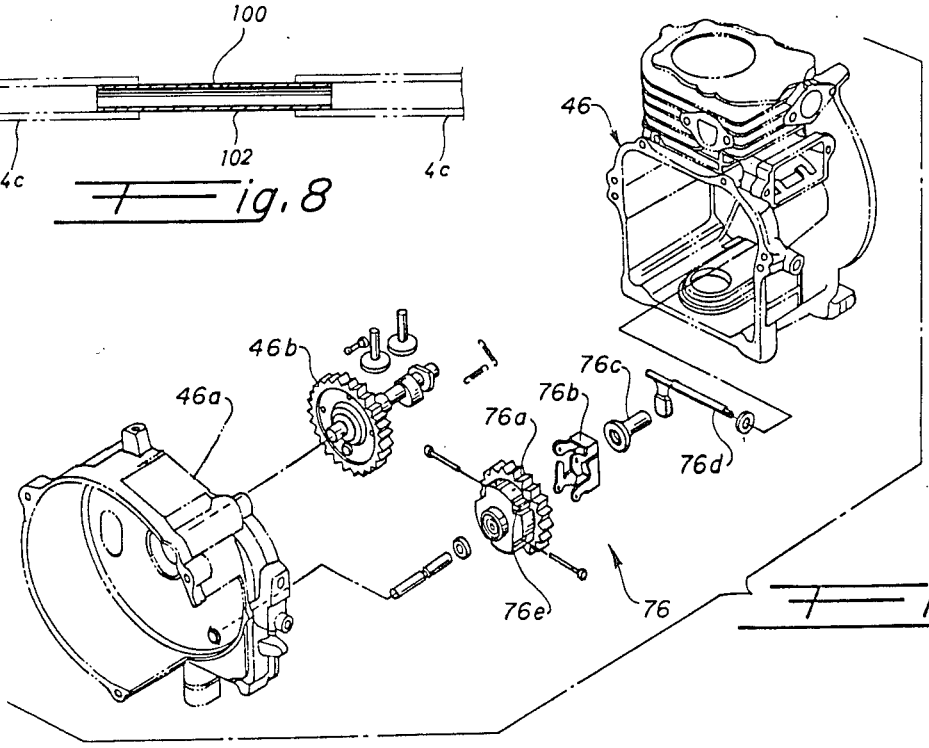
FIG. 6 is a perspective exploded view showing the governor mechanism.

On the rear side of the engine 46, as shown in FIG. 6, a governor mechanism 76 is provided. The governor mechanism 76 is composed of governor gear 76*a*, governor weight 76*b*, thruster 76*c*, governor shaft 76*d*, and others, and the movement of the governor gear 76*a* by the centrifugal force of the governor weight 76*b* is converted into a rotary motion of the governor shaft 76*d* by means of the thruster 76*c*. The governor shaft 76*d* projects to the rear side of the engine 46. There are also crankcase side cover 46*a* and cam shaft 46*b*.

Figure 7:
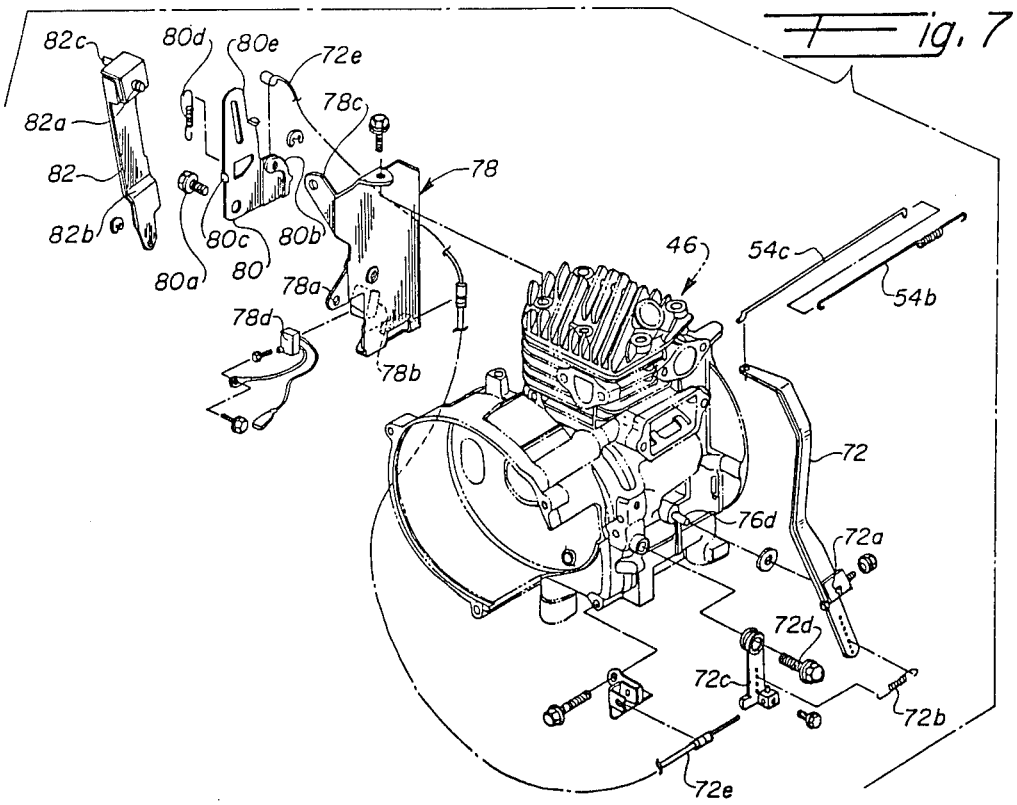
FIG. 7 is a perspective exploded view of an engine control unit.

The engine control unit is explained by referring to FIG. 7 showing the engine 46 obliquely from above the rear side. The governor shaft 76*d* if fixed in the center of rotation 72*a* of the governor lever 72, and the lower end of the governor lever 72 is linked to the regulator 72*c* by means of tension spring 72*b*. The regulator 72*c* is rotatably attached to the engine 46 by menas of bolt 72*d*. One end of a connection wire 72*e* (linkage member) is connected to the regulator 72*c*, and the connection wire 72*e* extends to the front side of the engine 46 running beneath it. At the front side of the engine 46, bracket 78, control lever 80, and control shift lever 82 are provided. The control lever 80 is rotatably fitted to the bracket 78 by means of mounting bolt 80*a*, and the other end of the connection wire 72*e* is connected to the wire connecting part 80*b* of the control lever 80. A detent 80*c* is fromed in the control lever 80, and a tension spring 80*d* is applied between the detent 78*a* of the bracket 78 and this detent 80*c*. The tension spring 80*d* is disposed at the right side of the mounting bolt in the assembled state shown in FIG. 3, and thrusts the control lever 80 in a direction to rotate clockwise around the mounting bolt 80*a*.

A limit switch mounting plate 78*b* and sub-bracket 78*c* are formed on the bracket 78. A protrusion 82*a* of the control shift lever 82 is slidably fitted in a slot 80*e* of the control lever 80. A step 82*b* is formed in the lower part of the control shift lever 82, and a protrusion 82*c* is also provided in the upper front side. This protrusion 82*c* fits into the inverted L-shaped groove 14*h* in FIG. 4 (*b*), and the knob 14*j* is fixed to the protrusion 82*c* projecting from the front side.

Furthermore, as shown in FIG. 3, a lever 84*a* of fuel cock 84 is linked to the lower end of the control shift lever 82. A fuel filter 84*b* is fitted to the fuel cock 84, to which are connected pipes 84*c* and 84*d* for feeding fuel from the fuel tank 4. The frequency changeover bolt 86 is adjustably fixed to the sub-bracket 78*c* of the bracket 78 by means of nut 86*a*, and it serves to define the rotation end position of the control lever 80 which is turned clockwise by the tension spring 80*d*. A limit switch 78*d* is fitted to the limit switch mounting plate 78*b* of the bracket 78. This limit switch 78*d* possesses the function to open and close the ignition circuit of the igniter 57 shown in FIG. 3 (*c*).

The operation is described below. While the knob 14*j* in FIG. 4 (*b*) is positioned at the lower end of the vertical groove part of the inverted L-shaped groove 14*h*, as shown in FIG. 7, the bracket 78 contacts with the step 82*b* of the control shift lever 82, and the ignition circuit of the igniter 57 is turned off, while the lever 84*a* of the fuel cock 84 is in closed position. When the knob 14*j* is moved upward along the vertical groove of the inverted L-shaped groove 14*h*, the bracket 78 is released from the step 82*b*, and the ignition circuit of the igniter 57 is turned on, while the lever 84*a* of the fuel cock 84 turns into the valve opening position. When the knob 14*j* moves up to the upper end of the vertical groove of the inverted L-shaped groove 14*h*, the control lever 80 is turned clockwise by the tension spring 80*d*, and the knob 14*j* slides rightward along the horizontal groove of the inverted L-shaped groove 14*h* until the upper end of the control lever 80 abuts against the frequency changeover bolt 86, so that the control lever 80 is positioned. At this time, the connection wire 72*e* connected to the wire connecting part 80*b* of the control lever 80 is pulled and turns the throttle valve lever 54*a* of the carburetor 54 up to an opening degree corresponding, for instance, to an engine speed capable of generating anternating currents of 60 Hz, by way of the governor lever 72. Or when changing to 50 Hz, the opening degree of the throttle valve lever 54*a* is changed by adjusting the position of the frequency changeover bolt 86. To stop the operation, when the knob 14*j* is moved leftward along the horizontal groove of the inverted L-shaped groove 14*h* by overcoming the tensile force of the spring 80*d* and is then returned to the lower end of the vertical groove of the inverted L-shaped groove 14*h*, the fuel cock 84 is closed, and the igniter 57 is turned off.

Since the intake air flowing into the intake hole 70*h* in FIG. 50 during operation runs in from the low temperature side space partitioned by the urethane seal 74 (FIGS. 2, 3, 4), the intake air of the engine is always kept at low temperature, and, what is more, dust is not sucked in from the intake hole 70 and the intake sound is quiet, not being released to outside. Furthermore, since the cooling air sucked in by the centrifugal fan 52*a* runs in from the low temperature side 52*d* partitioned by the urethane seal 74, the temperature is low and cooling efficiency is excellent. Moreover, the cooling air of the generator 50 sucked in by the centrifugal fan 50*b* is sealed by the packing 50*h* (FIG. 3, FIG. 3 (*a*)), and the external low temperature air from the louver 24*a* is directly supplied, so that the cooling efficiency is similarly excellent.

When checking the air cleaner 70, the bolt 70*g* is turned to remove the cover 16, and the internal element 70*e* is checked and cleaned. At this time, since the cover 16 is fitted to the front panel 14, the operator can check the air cleaner while facing the front panel, without having to move his position.

During operation of such encased engine generator, the rotating shaft 50*a* of the generator 50 is driven by the rotation of the engine 46, and the low temperature air outside the case 2 is sucked into the gover 50*g* by means of the centrifugal fan 50*b* (cooling fan). Since the voltage regulator 50*e*, rectifier 50*f* and other parts are incorporated in the part of the cover 50*g* facing the right side plate 24, they are cooled by the cooling air sucked in by the centrifugal fan 50*b*, so that the voltage regulator 50*e* and the rectifier 50*f* which are relatively less resistant to heat may not be damaged if provided together with the generator 50. Since a packing 50*h* is fitted to the cover 50*g*, high temperature air in the case 2 does not flow into the cover 50*g*, and only the external low temperature air is sucked into the cover 50*g* from the louver 24*a* (FIG. 2) of the right side plate, so that the cooling effect may be further enhanced.

During operation of such encased engine generator, the centrifugal fan (not shown) in the fan cover 52 is driven by the rotation of the engine 46, and the low temperature side air partitioned by the urethane seal 74 in FIG. 3 is passed into the cylinder head as cooling air. Part of the cooling air having cooled the cylinder head flows into the clearance 63 from the opening 62*a* in the upper cover 62, and further runs through the clearance rightward in the drawing while cooling the upper cover 62 and bottom of fuel tank 4 until it is discharged outside the case 2 from the louver 24*a* in the right side plate 24. At this time, the bottom of fuel tank 4 and upper cover 62 are cooled by the cooling air passing through this clearance 63.

At the same time, the remaining cooling air cools operating parts such as engine operation knob necessary for operation and maintenance mounted on the case wall. In this way, the operating parts such as engine operation knob are not exposed to the silencer cooling water and do not become hot. Besides, since the remaining cooling air for cooling the operating parts is enclosed within the case, the size of the case may be reduced while incorporating the silencer, and the operating parts may be disposed at the convenient front side regardless of the position of the silencer.

As a result of the experiment by the present inventors, by passing cooling water from the opening 62*a* into the clearance 63, the temperature in the clearance 63 and the fuel temperature in the fuel tank was lowered from 65° C. to 55° C., and the temperature was lower by 10° C. as compared with that of the conventional structure.

During operation of such encased engine generator, moreover, the vibrations due to rotation of the engine 46 are absorbed by the vibrationproof rubbers 39 fitted to the mounting legs 34. When mounting the engine 46, the positioning holes 37*c* in the mounting legs 34 are fitted to the ring projections 32, and the mounting legs 34 are fixed to the bottom plate 28 by means of bolts 34*a*, then the engine 46 is mounted and the flange 47 is engaged with the protrusions 35*d* and the engine 46 is fixed with bolts 36 (FIG. 2) by passing through the inward openings of the ring projections 32 from beneath the bottom plate 28.

Since the mounting holes 35*c* and positioning holes 37*c* of the engine 46 are provided at the engine 46 center side of the vibrationproof rubbers 39, the horizontal pieces 35*a*, 37*a* are, with the engine 46 secured to the bottom plate 28, positioned at the center side of the engine 46, so that the space required for mounting the engine 46 may be reduced.

When carrying such encased engine generator, the operator can lift the entire encased engine generator by holding the holding part 6*c* of the handle 6, but at this time the encased engine generator is shaken and the fuel in the fuel tank 4 pulsates. By this pulsation of the fuel, the mouth rings 4*a* provided at both right and left ends of the upper part of the fuel tank 4 are filled with fuel, but since the mouth rings 4*a* are relatively of large diameter and are forming a free space 4*p*, and also because they are projecting from above the fuel tank 4 and lower ends 4*f* of the connection pipes 4*b* are projecting into the mouth rings 4*a*, if the fuel pulsates, it is kicked back at the lower ends 4*f* and hardly flows into the connection pipes 4*b* from the mouth rings 4*a*, so that the fuel may not reach up to the vinyl tubes 4*c*. In case the fuel should flow into the vinyl tubes 4*c*, since the suction force of the fuel flowing down from the mouth rings 4*a* is greater than the capillary action occurring in the connection pipes 4*b*, the fuel flowing into the connection pipes 4*b* is sucked out into the fuel tank 4 and is returend.

According to the present invention, as described hereboave, by providing the fuel tank 4 along the upper surface of the case 2, disposing the engine 46 inside the case 2 beneath the fuel tank 4, disposing the generator 50 at one side of the engine 46, disposing the centrifugal fan 52*a* at the side of the engine 46, disposing the silencer between said fuel tank 4 and generator 50, and providing operating parts necessary for operation and maintenance, such as front panel 14, air cleaner cover 16, starter handle 18 and lubricating oil feed port 20, at the front plate 12 of the case 2, all handlings necessary for operation can be effected while facing the front plate 12, so that the operator can manipulate easily and quickly without having to move his position.

Furthermore, since the silencer 58 which is hot and emits noise is located at the rear side of the case, the operator can handle easily without any effect of hot air or noise, and it is also sanitary because the exhaust gas is discharged rearward.

By disposing the engine 46 inside the case, disposing the silencer 58 at one side of the engine 46, placing the generator and silencer side by side, disposing the air cleaner 70 in the space at the low temperature side partitioned by the urethane seal 74 (partitioning member) provided on the outer circumference of the fan cover 52 which envelopes the cooling fan, and opening the air intake hole 70*h* of the air cleaner toward the inside of the case, the air flowing into the air intake hole 70*h* runs in from the space at the low temperature side partitioned by the urethane seal 74 from the high temperature silencer 58 side, so that the output of the engine 46 may be increased.

Since the air intake hole 70*h* is opened toward the inside of the case 2, the intake sound hardly reaches up to the operator standing at the front of the case 2, and the intake noise may be suppressed, and dust is hardly sucked into the intake hole 70*h* and contamination of the element 70*e* is prevented, so that the checking interval of the air cleaner 70 may be extended.

Furthermore, since the cover 16 of the air cleaner 70 may be disposed at the front side of the case 2, the air cleaner 70 may be checked or cleaned easily from the front side of the case 2.

By disposing the engine 46 inside the case 2, disposing the governor mechanism 76 at the rear side of the engine 46, disposing the engine operating mechanism at the front side of the engine 46, and providing connection wires 72*e* for interlocking and linking the engine operating mechanism and governor mechanism 76, the front and rear spaces of the engine 46 may be effectively utilized, and the overall size of the encased engine generator may be reduced by minimizing the size of the case 2.

What is more, since the engine operating mechanism can be manipulated by the knob 14*j* of the front panel 14, the engine 46 can be controlled while facing the front panel 14, so that manipulation may be easy.

By disposing the engine 46 inside the case 2, disposing the generator 50 at one side of the engine 46, providing a cover 50*g* for covering the outer surface of the generator 50, disposing the centrifugal fan 50*b* for cooling the generator inside the cover 50*g*, and providing electrical parts such as voltage regulator 50*e* and rectifier 50*f* in the part of the cover 50*g* facing the right side plate 24 to as to pass in the cooling air from the louver 24*a* of the right side plate 24 by keeping the right side plate 24 in tight contact with the end face of the cover 50*g* facing the right side plate 24, the generator 50 and its electrical parts may be provided integrally, and the overall size of the encased engine generator may be reduced by effective utilizing the space in the case 2.

Furthermore, since the voltage regulator 50*e* and rectifier 50*f* in the cover 50*g* are cooled by the cooling air sucked in through the centrifugal fan 50*b*, if the voltage regulator 50*e* and rectifier 50*f* are provided together with the generator 50, their damage by heat may be prevented.

Still more, since the cover 50*g* and right side plate 24 are in tight contact, high temperature air in the case 2 will not get into the cover 50*g*, and only the external low temperature air flows in, so that the cooling efficiency of the voltage regulator 50*e* and rectifier 50*f* may be further enhanced.

The tight contact of the cover 50*g* and right side plate 24 may be achieved also by metal contact or other means, aside from the packing 50*h*.

By providing the fuel tank 4 along the upper surface of the case 2, disposing the air-cooled engine 46 having a cooling fan inside the case beneath the fuel tank 4, disposing the generator 50 at one side of the engine 46, disposing the silencer 58 between said generator 50 and fuel tank 4, and providing the upper cover 62 of the silencer 58 between the silencer 58 and fuel tank at the clearance 63 against the fuel tank 4 so that the cooling air from the cooling fan may flow into the clearance between upper cover 62 and fuel tank 4, the bottom of the fuel tank 4 and the upper cover 62 may be cooled by passing the cooling air into the clearance between the fuel tank 4 and upper cover 62, and overheating of the fuel tank 4 by the silencer 58 may be prevented even if the silencer 58 is located between the generator 50 and fuel tank 4.

Therefore, the overall size of the encased engine generator may be reduced by effectively utilizing the space in the case, and the safety may be enhanced at the same time by preventing overheat of the fuel tank 4.

The cooling air flowing in the clearance 63 is not limited to the flow from the opening 62*a*, but, for example, may be passed by other means such as direct introduction from the fan cover 52.

By forming positioning holes 37*c* to fit to the ring projections 32 (positioning projections) of the bottom plate 28 in the nearly horizontal pieces 37*a* of the lower plates 37 of the mounting legs 34 fixed to the bottom plate 28, forming mounting holes 35*c* of the engine 46 in the upper plates 35, and providing vibrationproof rubbers 29 between the inclined pieces 35*b*, 37*b* of the upper plates 35 and lower plates 37 so that the relative position with respect to the bottom plate 28 is determined by the positioning holes 37*c* in the lower plates 37, the mounting legs 34 may be disposed at specified positions when mounting the engine 46 only by the simple job of fixing the mounting legs 34 to the bottom plate 28 by fitting the positioning holes 37*c* to the ring projections 32. Therefore, the vibrationproof rubbers 39 are free of deflection due to deviation of mounting position as experienced conventionally, and the risk of action of preload due to deflection may by eliminated, and the service life of the vibration proof rubbers 39 may be extended.

The vibrationproof rubbers 39 may not be necessarily fixed to the both inclined pieces 35*b*, 37*b*, but may be fixed by other means such as setbolts.

By providing the fuel tank 4 along the upper surface of the case 2, providing the handle 6 above the fuel tank 4, providing large-diameter mouth rings 4*a* projecting from the upper surface of the fuel tank 4 and opened at the upper ends, affixing small-diameter connection pipes 4*b* to the opening of the mouth rings 4*a*, forming a kick-back cavity in the mouth rings 4*a* at the connection parts, connecting one end of vinyl tubes 4*c* stored in the handle 6 to the connection pipes 4*b*, and opening the other ends of the vinyl tubes 4*c*, if the fuel tank 4 is inclined and the fuel pulsates while the encased engine generator is being carried, the fuel hardly flows into the connection pipes 4*b* from the mouth rings 4*a*, and the fuel if accidentally flowing into the connection pipes 4*b* will be sucked by the difference in the surface tension due to the capillary action of the connection pipes 4*b* and the mouth rings 4*a* and fall into the fuel tank 4, so that fuel leak from the fuel tank 4 may be prevented.

Figure 8:
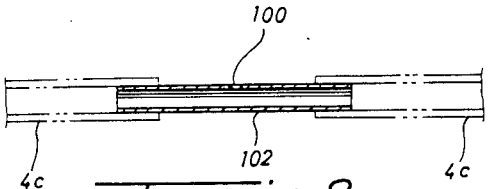
FIG. 8 is a vertical sectional view showing other embodiment of the air bleeder of fuel tank.

The two vinyl tubes 4*c* may not be necessarily opened within the handle 6, but may be connected for example, by a pipe joint 102 having an air vent hole 100 as shown in FIG. 8.

What is claimed is:

1. An encased engine generator having an air-cooled engine and a generator housed in a case approximately structured in a rectangular parallelepiped having a front and a rear, wherein a fuel tank is provided along the upper surface of the case, an engine having a cooling fan at its side is disposed within the case beneath said fuel tank, a generator interlocked with said engine is disposed at the downstream side of the cooling air from said cooling fan, a silencer is disposed in a rearward space between said fuel tank and generator so that its outer circumference may be cooled by part of said cooling air, and operating parts such as engine operation knob necessary for operation and maintenance are provided on the front face wall of the case which encloses the remaining cooling air while cooling and exhaust discharge occurs from the rear, away from the operator.

2. An encased engine generator having an air-cooled engine, generator and auxiliary units housed in a case approximately structured in a rectangular parallelepiped, wherein an air-cooled engine is disposed in the middle of the case, a generator and silencer are placed side by side, a cooling fan is disposed at one side of the engine, an air cleaner is disposed in the space at the low temperature side partitioned by the partitioning member provided on the outer circumference of the fan cover to cover the cooling fan, and the air intake hole of said air cleaner is opened toward the inside of the case.

3. An encased engine generator as set forth in claim 2, wherein the cover of said air cleaner is detachably fitted to the front side of the case.

4. An encased engine generator having an air-cooled engine and a generator housing in a case approximately structured in a rectangular parallelepiped, the case having at least one side plate provided with a louver, comprising a generator disposed at one side of the engine, a tubular cover to cover the outside of the generator, a cooling fan for drawing air in through the louver in the side plate of the case for cooling the generator, the fan being disposed in the tubular cover, a silencer within the case above the generator, a silencer cover disposed around the silencer and cooperating with the tubular cover to direct air around the silencer, the silencer cover further comprising a top element having an opening therein, the top element located below the fuel tank and separated from the fuel tank by a clearance which allows air passing out of the opening to enter the clearance and means for passing at least a portion of the air discharged from the cooling fan through the opening and into the clearance.

5. An encased engine generator as set forth in claim 4, wherein electrical parts of the generator are provided in the free space formed by the case side plate and the tubular cover inside which covers the outside of the generator.

6. An encased engine generator having an air-cooled engine with a cooling fan and a generator housed in a case approximately structured in a rectangular parallelepiped, wherein a fuel tank is provided along the upper surface of the case, an air-cooled engine is disposed in the case beneath said fuel tank, a generator is disposed at one side of the engine, a silencer is disposed between said generator and fuel tank, and an upper cover of the silencer is provided between the silencer and fuel tank at a clearance against the fuel tank, so that the cooling air from said cooling fan may be passed into the clearance between the upper cover and fuel tank.

7. An encased engine generator as set forth in claim 6, wherein said upper cover covers the cylinder head of the engine, and an opening is formed in the upper cover at the part to cover the cylinder head.

8. A fuel tank air bleeding device of an encased engine generator having an engine and a generator housed in a case approximately structured in a rectangular parallelepiped, wherein a fuel tank is provided along the upper surface of the case, a handle is provided above the fuel tank, large-diameter mouth rings project from the upper surface of the fuel tank and have an opening at the upper end, small-diameter connection pipes pass through openings of the mouth rings so that their lower ends may project into openings, a free space located between the bottom of the connection pipes and forming a fuel baffle in the mouth rings at said connection part.

9. A fuel tank air bleeding device of an encased engine generator as set forth in claim 8, wherein the upper end side passages of connection pipes are formed by flexible tubes extended in the handle.

10. In an encased air cooled engine generator having a case and a fuel tank, the improvement comprising a cooling duct within the case, the cooling duct having a tubular portion and a manifold, the tubular portion extending between the engine and a side panel and having disposed therein a generator and a generator cooling fan, the manifold adapted to receive air from the tubular portion and located above the generator and below the fuel tank, the manifold having an opening and having disposed therein a silencer for the engine, the manifold having a substantially parallel relationship with the fuel tank and separated from it by a clearance, wherein cooling air from the duct enters the clearance through the opening.

11. In an encased air cooled engine-generator having a case, a fuel tank, front, rear and side case panels, a top, a bottom and a handle, the improvement comprising, a cooling duct comprising a tubular portion and a manifold, the tubular portion extending from the engine to a side panel and having therein a cooling fan and a generator; the manifold extending from the tubular portion and having an opening, the manifold having located therewithin a silencer, whereby air from the tubular portion flows over the generator and part of the air flow is diverted to the manifold where the air passes over the silencer and exhausts through a vent, the silencer exhausting through the rear panel, the manifold located above the center of the tubular portion and rearwardly, and below the fuel tank; a narrow clearance separating the manifold from the fuel tank, whereby air from the manifold may enter the clearance through the opening, and the tubular portion affixed to the side panel snugly.

12. In an encased engine-generator having a case, a fuel tank and a hollow handle, the improvement comprising at least one spill proof vent comprising a cylindrical mouth ring upstanding on the top of the fuel tank, a smaller diameter connection pipe extending from the top of the mouth ring, a circumferential lip extending from the connection pipe downwardly into the mouth ring, a baffle space outlined by the space in the mouth ring external to the lip and between the lowermost extremity of the lip and the highest internal point in the mouth ring, whereby the lip and baffle space provide an impediment to the flow of fuel from the tank into the connection pipe, and a small diameter tube attached to the connection pipe and leading into the handle and extending substantially the length of the handle.

13. The improvement of claim 12, wherein two spill proof vents are provided, the small diameter tubes of each extending into different ends of the hollow handle.

14. In an encased air cooled engine-generator having a handle, the improvement comprising, an internal ducted generator, a silencer having a cooling manifold, the silencer exhausting to the rear of the engine generator, operator controls located on the front of the engine generator, and two spill proof vents each having an internal baffle and a drain tube, the drain tube extending within the handle, and the drain tubes being approximately the length of the handle.

* * * * *